US006684541B2

(12) United States Patent
McPhaul

(10) Patent No.: US 6,684,541 B2
(45) Date of Patent: Feb. 3, 2004

(54) PRAYER SCROLL

(76) Inventor: Byron Ashley McPhaul, 1740 Post Plant Rd., Quincy, FL (US) 32351

( * ) Notice: Subject to any disclaimer, the term of this patent is extended or adjusted under 35 U.S.C. 154(b) by 65 days.

(21) Appl. No.: 09/766,224

(22) Filed: Jan. 19, 2001

(65) Prior Publication Data

US 2002/0095837 A1 Jul. 25, 2002

(51) Int. Cl.[7] ..... G09F 11/18
(52) U.S. Cl. ..... 40/517; 40/514; 160/301; 160/305
(58) Field of Search ..... 40/514, 515, 517; 434/415; 160/245, 305, 306, 301, 302, 370.22

(56) References Cited

U.S. PATENT DOCUMENTS 1,136,575 A * 4/1915 Wohlcke et al. ..... 40/517 X
1,320,918 A * 11/1919 Reyer ..... 40/514 X
3,245,635 A * 4/1966 Signor ..... 40/517 X
3,884,351 A * 5/1975 James ..... 40/517 X
4,574,504 A * 3/1986 Holmer ..... 40/660
4,646,453 A * 3/1987 Reinhart ..... 40/117
5,359,797 A * 11/1994 Williamson ..... 40/517 X
5,690,317 A * 11/1997 Sandsborg ..... 256/1
5,813,449 A * 9/1998 Patmore et al. ..... 160/370.22
6,089,306 A * 7/2000 Frey, Jr. ..... 160/302

FOREIGN PATENT DOCUMENTS

GB 316636 * 7/1929 ..... 40/517

* cited by examiner

*Primary Examiner*—Brian K. Green

(57) ABSTRACT

A secure hand-held prayer scroll is provided for creating and retaining writings such as prayers. A replaceable paper webbing is retained on, and in use unwound from, a rotary spool within a hollow housing. To rewind the paper webbing onto the spool, a locking wheel is unlocked by use of a button. A retraction spring and comfort spring balance the return force of the paper webbing. A pen may be stored within the article for writing purposes in use. A key activates a locking device to prevent unwanted release of the paper webbing.

4 Claims, 12 Drawing Sheets

Figure 1C
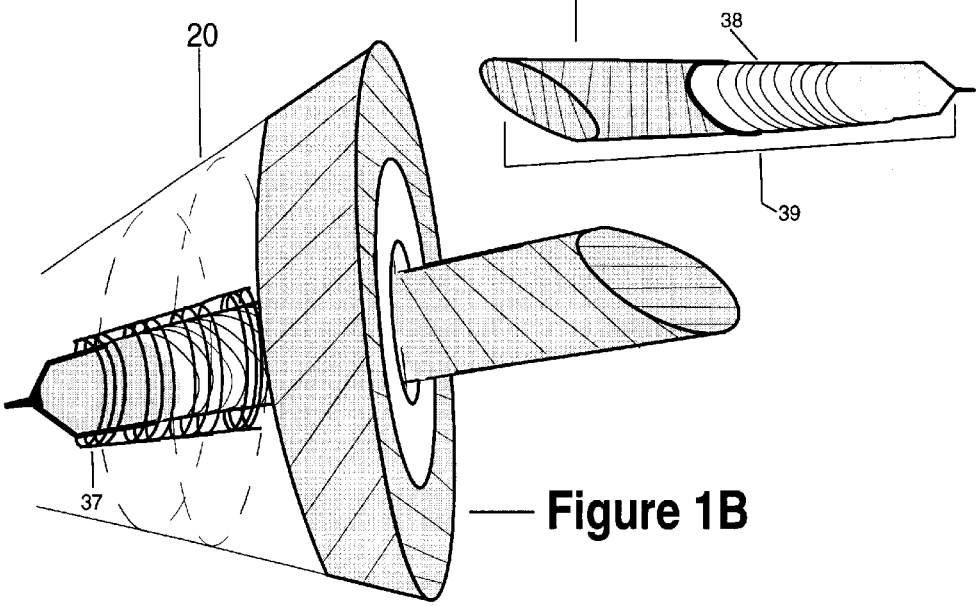
Figure 1B
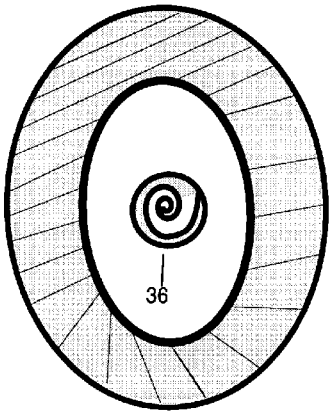
Figure 1D

1

2 head
arm
3

4

5

6

7

8
9
base teeth

10

11

12

13

14

15

16

17

18
bottom

21

19
top

20

22

23
head neck
body
tail
24 head
tail
25
26 head tail
27

L-arm
R-arm
tail
28

29
30

31

32

33

34

35

40

36

37

38

39

41

42

43

44

45

46
teeth head
arm
47

48
49

PRAYER SCROLL

BACKGROUND

1. Field of Invention

This invention relates to scrolls and or ancient books written as a roll of parchment or papyrus, used as a support especially, for documentation or painting.

2. Description of Prior Art

Ancient times of documentation always put us in the mind of things that were done differently than now. Scrolls were something that ancient people used as books. In those days, prayers, prophecies, documentation and even paintings were created on rolls of papyrus or parchment papers. This process was time consuming and expensive. The Chinese and Japanese used scrolls for writing and painting. In Isaiah 8:1 God said, take thee a great roll (large scroll), and write in it with a man's pen concerning Mahershalalhashbaz.

After the finishing of the information, the roll of paper was then hand rolled by one or two rods on the other lips of the paper which were made of wood, ivory or bronze. The scrolls were then later placed into jars. The problem with these older styles of supporting information was one, no protection from thieves or curious infiltrators who may have wanted to view the valuables; and two, you could not singularly transport the material without exposing it to the harsh weather because of the large jars. Color changes in the paper and ink fading was another problem.

Centuries later, inventors have created several types of ways for containing or transporting materials such as prayers, visions, or personal prophecies. U.S. Pat. No. 5,882,095 (Portable Prayer Alter) to Green, Donald E. Mar. 26, 1998 and Patent USDO245,381 (Family Prayer Alter) to Ebert Lee Lilly Sep. 18, 1974 are both much too large and heavy of a contraption to transport anywhere without a truck. Although, Patent USD0356210 (Pouch for Containing Prayer and Supplications) to Howell, Kimberly A. May 28, 1993 is small and easily transportable, it still has no sure means of protecting the contents of the pouch from being viewed by others. Patent USD0354838 (Prayer Vessel) to Felice; Shirley A. Jul. 6, 1993 falls into the same category as being to large and heavy to transport easily, although it's relative to the prehistoric jar method of protecting information, it requires you to make all the sacrifices such as supplying pen and paper to write on. Patent USD0333614 to Miguel Gae L. Sep. 26, 1990 is also too large of an item to easily transport singularly. Although it can contain your prayer materials, it by no means protects them from curious folk taking a peak at your petitions to God. Patent USD0319415 (Prayer Token) to Johnson; C. Lamar in Sep. 27, 1989 does have the Lords prayer on it, that's all. What if my petitions to the Lord need to be more direct and personal? This method is not sufficient in containing prayer request.

Objects and Advantages

Accordingly, besides disadvantages of different methods of containing prayers or prayer documents, several objects and advantages of the present invention are:

a) One hand mobile and lightweight b) Provides adequate paper material and pen for writing out prayers, devotionals, visions, prophecies, or other information.

c) Ensures complete privacy and protection from intrigued infiltrators by providing a device securing locking mechanism d) Does not take up large amounts of space e) Allows you to pray for hundreds of people at one time.

f) Allows changeability of paper for new prayers and pen refills for more writing g) Less expensive to maintain and replace parts Still further objects and advantages will become apparent from a consideration of the ensuing description and drawings

SUMMARY

In accordance with the present invention a Prayer Scroll comprises a handle grip with a top and bottom end. The handle grip itself is from where which the scroll paper extends for writing; the top end of the handle is from where which the scroll paper writing pen is inserted or detached. The bottom end of the handle is from where which the scrolls paper it can be prevented from extension as of being in a locked position by means of a key.

DRAWING FIGURES

FIGS. 1 and 1A are side views of an embodiment of the invention.

FIG. 1B illustrates a pen according to the invention within a frame pen entrance.

FIG. 1C depicts a pen according to the invention.

FIG. 1D is a end view of the embodiment of FIG. 1B.

FIG. 1E depicts an article of the prior art.

FIG. 2 is a detailed and overall center view of an internal operation of a center and top portion of the inventive mechanism.

FIG. 2A is an internal exploded view of the top portion of the inventive mechanism.

FIG. 2B is a detailed perspective view of the invention showing an internal operation of the parts within a bottom portion of the mechanism of FIG. 2A.

FIG. 2C is an internal perspective view of the bottom components assembled.

FIG. 2D is an exploded perspective view of the embodiment of FIG. 2C.

FIG. 2E is a detailed view of the internal arrangement of components in a top portion of the mechanism.

FIGS. 2F and 2G are exploded views showing the operation of the locking system with the top portion of the mechanism.

FIGS. 3 to 3AV illustrate various specific components of the present invention as discussed in detail herein.

REFERENCE NUMBERS IN DRAWINGS

1: paper webbing
2: bush
3: sun gear
4: three planetary gears
5: stub axles
6: ring gear
7: spigot
8: coiled retraction spring
9: slot
10: drum
11: central orifice
12: ratchet member
13: comfort spring
14: boss -continued 15: spool mount
16: top roller
17: rotary spool
18: bottom roller
19: central frame embodiment
20: top frame embodiment
21: bottom frame embodiment
22: locking teeth wheel
23: teeth
24: locking lever
25: release button
26: locking lever spring
27: release button shaft
28: wheel mount
29: small roller
30: aligner
31: roller aligners
32: exit
33: bottom roller spring
34: bottom roller mount
35: top roller mount
36: pen entrance
37: internal treads
38: external treads
39: pen
40: extension flap
41: socket
42: bolt
43: bolt mount
44: key entrance
45: key
46: handle
47: stop lock bracket
48: stem extension
49: key cylinder
50: Rolling Rod
51: Paper

DESCRIPTION OF DRAWINGS

An external embodiment of the present invention is illustrated in FIG. 1 & FIG. 1A. The frame of the current invention is viewed as a cylinder with opposite facing obtuse angled ends. The external frame of the current invention is divided into three sections, a top frame embodiment 20, a central frame embodiment 19, and a bottom frame embodiment 21. Both opposite facing obtuse ends (top frame embodiment 20 & bottom frame embodiments 21) have base ends, which are oval shape with a diagonal degree turn. The central frame embodiment 19 is the hollow cylinder section of the current invention. A handle 46 is connected to the end of a paper webbing 1. The handle is designed for the pointer and thumb fingers. The paper webbing 1 is a strong thin sheet material, which does not warp when unrolled. The top of the paper webbing 1 is connected to a thin flat bolt mount 43, dimensions 0.5 in×5.5 in, which is made of a strong firm plastic material. A bolt 42 in the shape of a cylinder with octagon sides is attached to the bolt mount as one piece. A Socket 41 made of a strong lightweight metal whose internal ring is shape like an octagon is attached to the end of a extension flap 40. The extension flap 40 is made of a strong flexible sheet material, which can be repeatedly bent and straightened out without tearing. The extension flap 40 top ends exceeds through an exit 32 and attaches to a rotary shaft 17 (shown in FIGS. 2 and 2E).

An exploded view showing the top frame embodiment 20 of the present invention is illustrated in FIG. 1B. A pen 39 (dimensions 0.5 in×4 in) is partially inserted into a pen entrance 36 (dimensions 0.7 in×2.5 in), which is as an appendix within the top frame embodiment 20. The pen 39 has an external thread 38, which raps around the center embodiment of the external body of pen 39. An internal thread 37 is housed within the top frame embodiment 20 and connected to a pen entrance 36.

Figure 1:
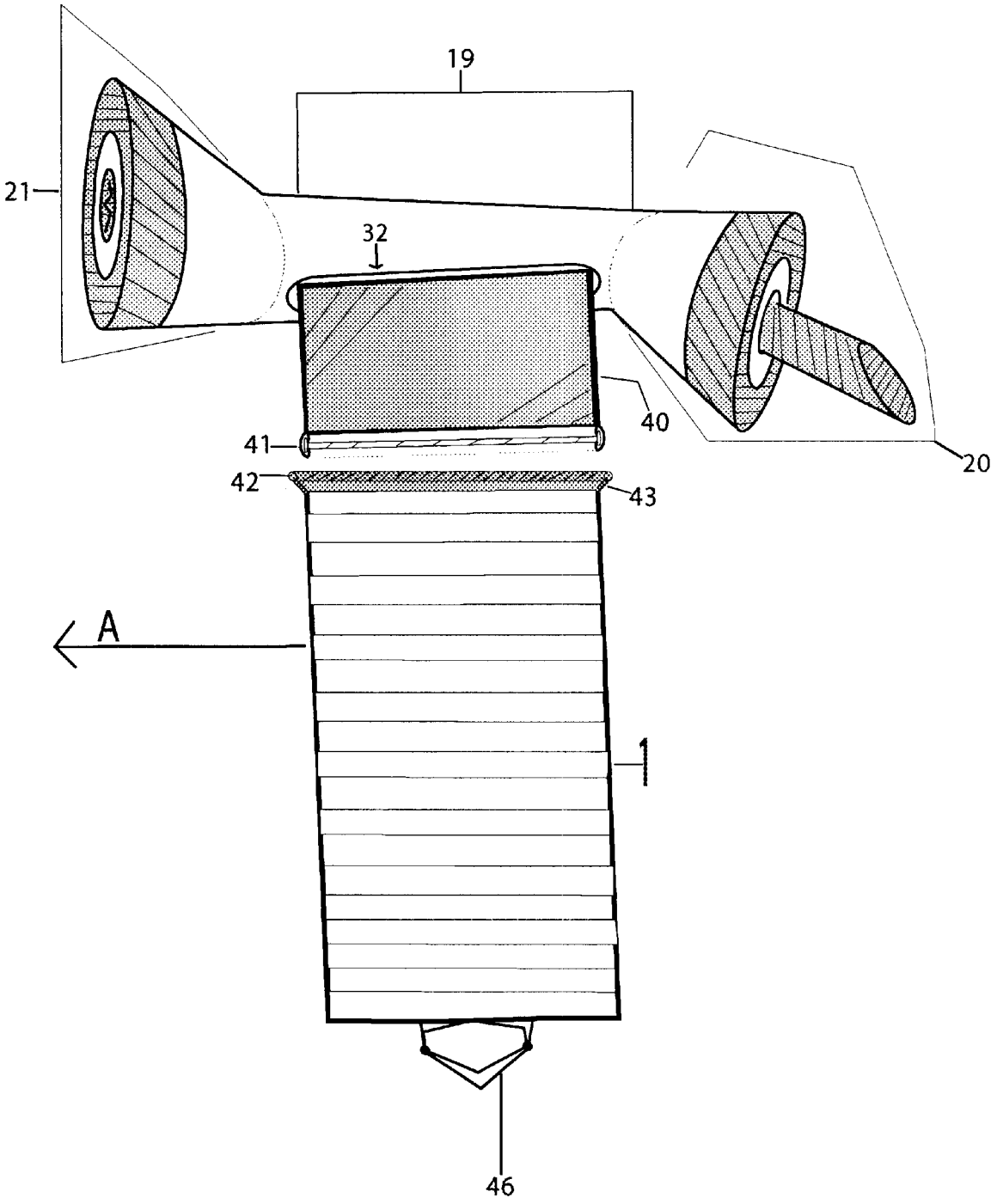

The items about to be discussed below are associated with a central frame embodiment 19. A wheel mount 28 (also shown in FIGS. 2A & 2B) is a singular metal peace shaped like a capital "T" for securing in place a locking teeth wheel 22, a locking lever 24 and a locking lever spring 26. The wheel mount 28 is composed of a right and left arm, and a tail end. A release button shaft 27 (also shown in FIGS. 2A & 2B) is co-axle within the release button 25, it is a narrow metal rod with a tail end and a head, the tail end is grounded within a release button 25 (not shown) and the head extends from the release button 25 and is secured to the tail end of the locking lever 24. A locking lever spring 26 (also shown in FIGS. 2A & 2B) is a spring back action urge; it is sandwiched between the locking lever 24 and the tail end of the wheel mount 28. The release button 25 (also shown in FIGS. 2A & 2B) is a small dimension (¼ in×0.5 in) metal rod. The head of the release button remains extended out from the central frame embodiment 19 while the body remains hidden within the central frame embodiment 19. The locking lever 24 is secured to the locking lever spring 26. The locking lever 24 (also shown in FIGS. 2A & 2B) is a solid piece made of a very durable lightweight metal. The locking lever 24 is shaped like a zigzag, and consists of a head, neck, body and tail end. The head rests on teeth 23 and pivots every rotation of a locking teeth wheel 22. The body of the locking lever 24 partially houses the locking lever spring 26. The teeth 23 are a solid piece which is part of the locking teeth wheel 22. The teeth 23 are made of durable lightweight metal material, which are locking or catch grooves. The locking teeth wheel 22 (also shown in FIGS. 2A & 2B) is a wheel device, which is made of the same material as the teeth 23 which is of the same solid peace. The locking teeth wheel 22 is sandwiched between the wheel mount 28 and a spool mount 15 for securing purposes. The spool mount 15 (also shown in FIG. 2E) is one solid peace made of a durable lightweight material. The spool mount 15 has 2 layers, one being the connection point of a rotary spool 17 and the other is a header. The rotary spool 17 (also shown in FIG. 2E) is a solid rotating cylinder made of a strong, lightweight plastic material. A top roller mount 35 and a bottom roller mount 34 are (also shown in FIGS. 2A & 2B) a flat metal piece shape like the letter "L", with an attaching spool arm, designed for a top roller 16 and a bottom roller 18. The bottom roller 18 is a rotating cylinder, which extends the length of paper webbing 1. Bottom roller 18 is made of a smooth, durable, lightweight plastic. The top roller 16 is in the same design format and made of the same material as the bottom roller 18, but only larger. A bottom roller spring 33 is made of a durable metal material; it has two connecting end points. One point of the bottom roller spring 33 attaches to the inward wall of the central frame embodiment 19 and the other attaching end point is connected to the head of the bottom roller mount 34.

The items about to be discussed below are associated with a bottom frame embodiment 21 of FIG. 2. A bush 2 (also shown in FIG. 2E) is a non-rust lightweight metal plate with an attaching hollow sleeve. The bush 2 has 4 insertion points for stubs on sash. A stub axis 5 (also shown in FIG. 2E) is a small, round metal branch. The sun gear 3 (also shown in FIG. 2E) is a brass gear with a head and an extended attaching arm from it. A 3 planetary gears 4(also shown in FIG. 2E) are round gears with matching sears. A ring gear 6 (also shown in FIG. 2E) is a lightweight metal plate with an attached hollow sleeve for housing gears. A spigot 7 (also shown in FIG. 2E) is a snorkel cylinder with two open ends. The top end of the spigot 7 is an insertion point for a slot 9 and the bottom end is beveled outward with internal matching grooves, which fit the head of a sun gear 3. The slot 9 is a small device made out of a very strong metal that does not bend of break. The slot 9 (also shown in FIG. 2E) has a base with two extending teeth from it and a gap between the two teeth.

Figure 2:
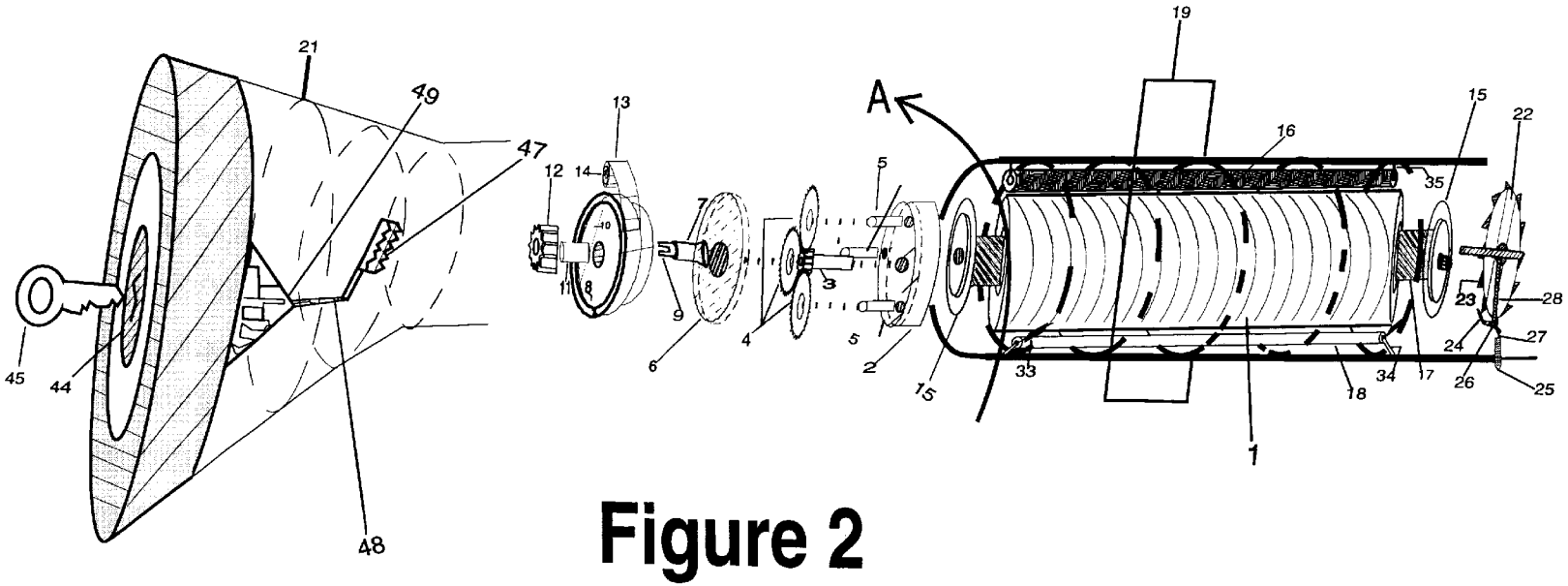
FIG. 2 is a detailed view of the present invention consisting of a hollow central frame embodiment 19 and a bottom frame embodiment 21. A key cylinder 49 is mounted on the internal base end of the bottom frame embodiment 21, which internal components are compatible to a key 45. A metal stem extension 48 is attached as a component via the key cylinder 49. A stop lock bracket 47 is made of a lightweight durable metal with locking teeth and has a rectangle shaped head, it is attached via the stem extension 48. A key 45 is a small brass key designed to function corporately through a key entrance 44 and within the key cylinder 49. The key entrance 44 is mounted to the external base of the bottom frame embodiment 21. The items discussed thus far are associated with a bottom frame embodiment 21.
Figure 2A:
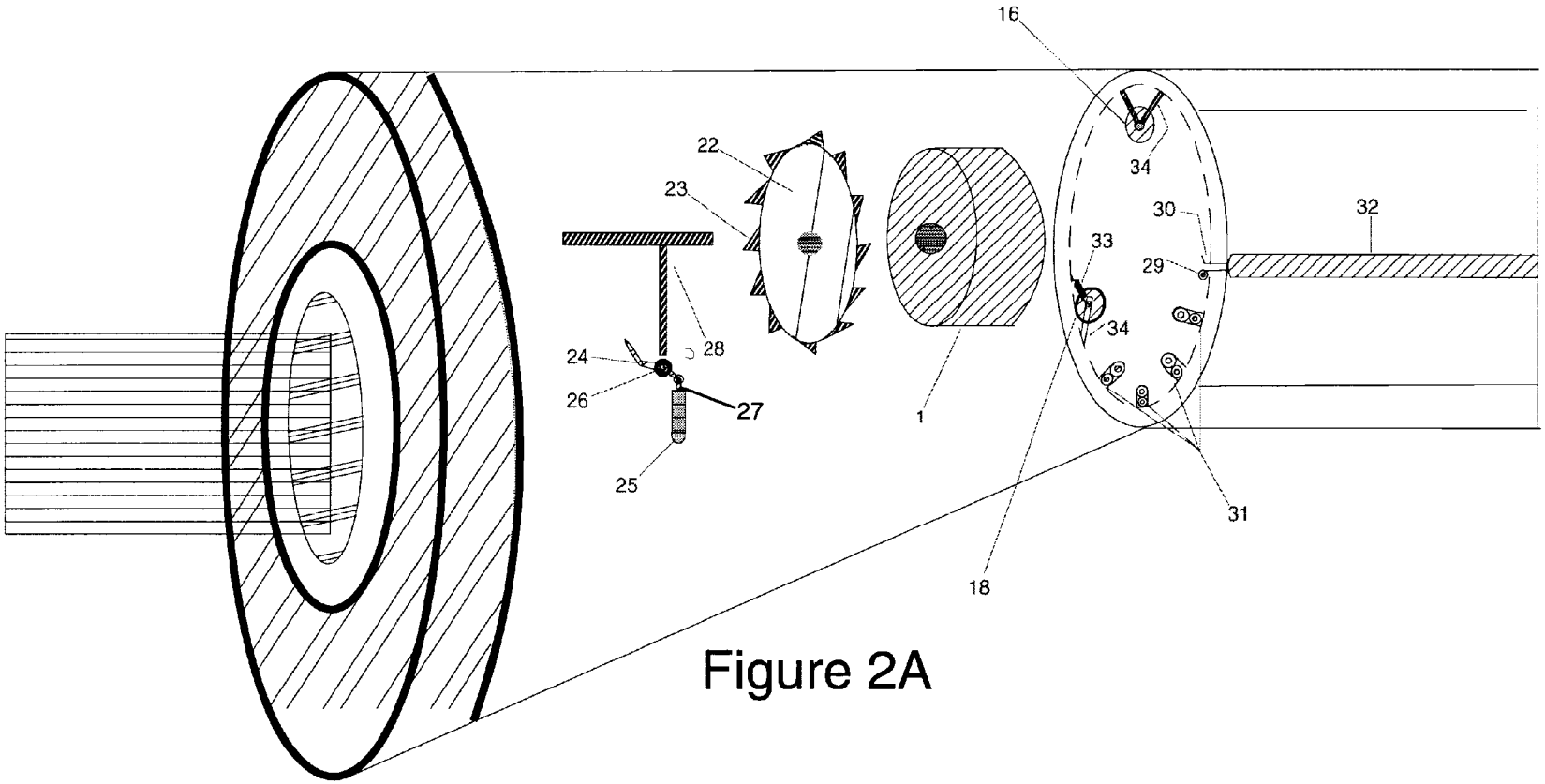
Figure 2B:
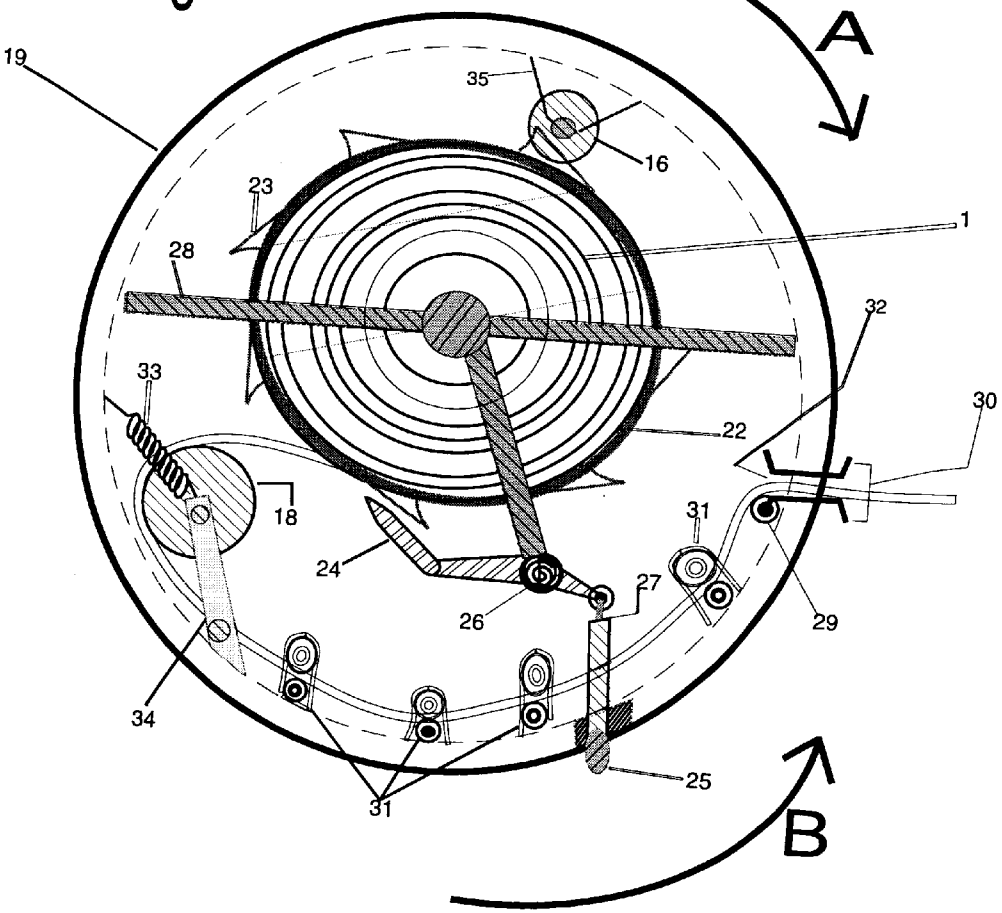
Figure 2D:
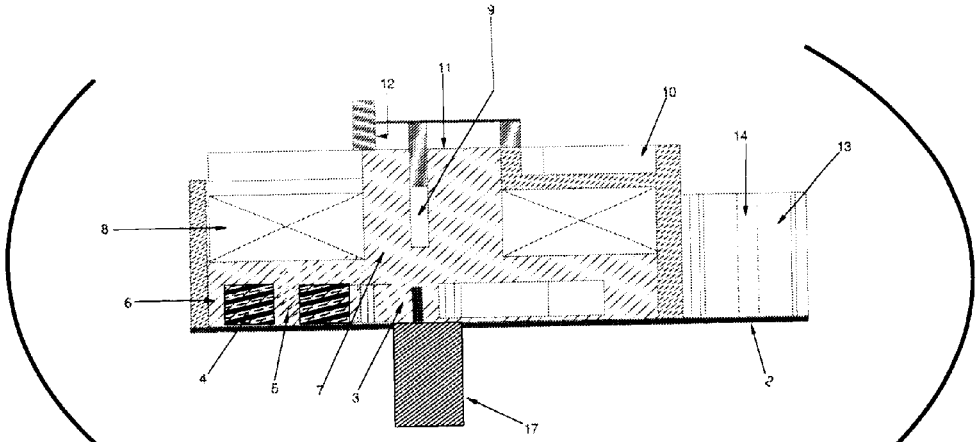
Figure 2C:
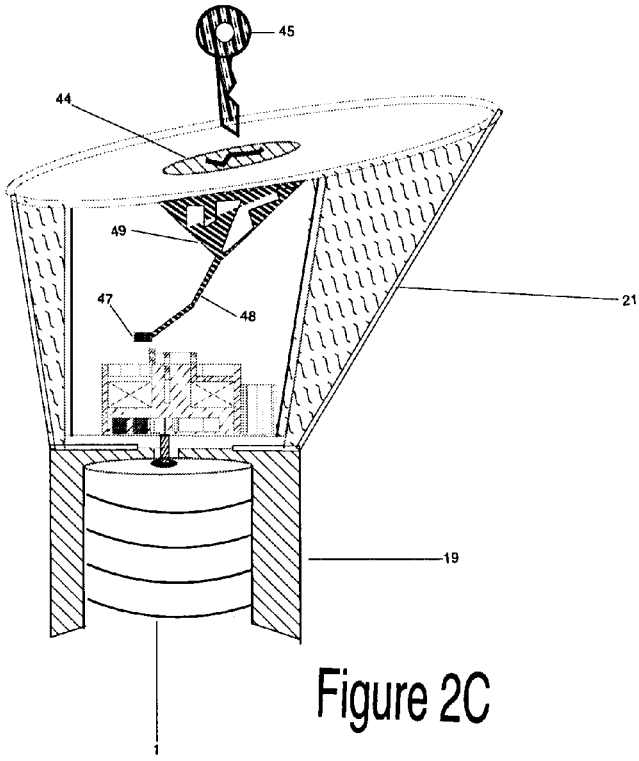
Figure 2E:
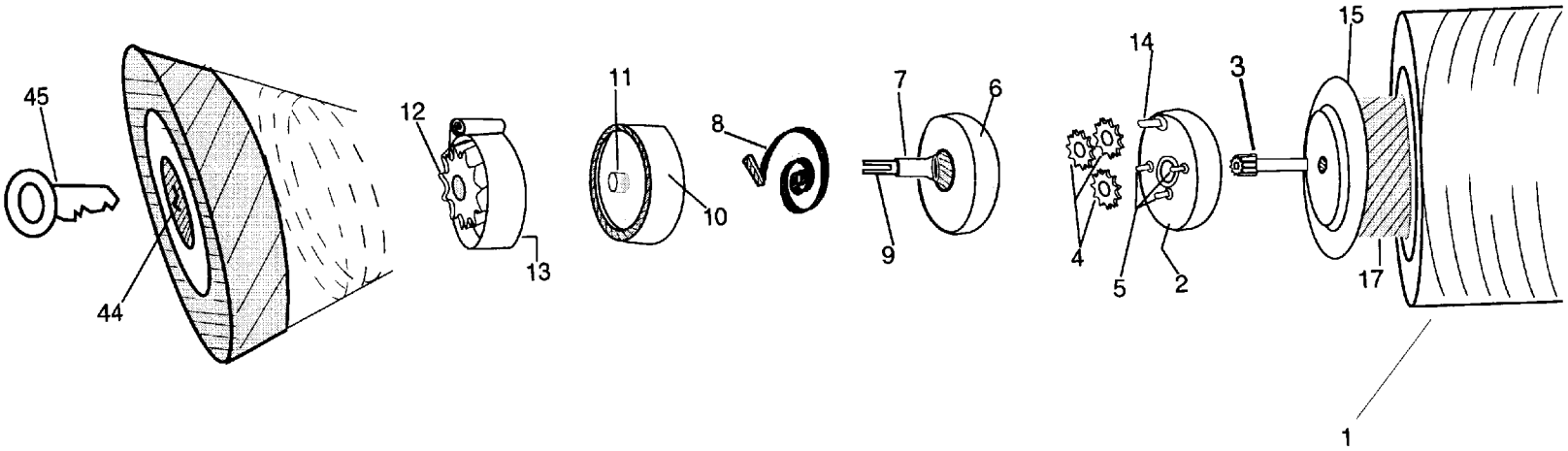

FIG. 2E is a more detailed and perspective view of the following descriptive drawings for the present invention. A drum 10 is a metal device with a sash and an attached extending hollow sleeve for housing. Within the hollow sleeve of the drum 10 is a stop on the wall of it (not shown). A central orifice 11 (also shown in FIG. 2) is a co-axle snorkel. The central orifice 11 hollowed inside is larger than the external walls of the spigot 7 and the slot 9. A boss 14 is a metal branch that is slightly larger in size and length than the stub axis 5 which are also shown in FIG. 2. A comfort spring 13 is a round one-peace spring device, which is a jacket to the drum 10. The comfort spring 13 has a curled tail end, which has an opened end for insertion. A ratchet member 12 is a round brass metal device, resembles a sear. The ratchet member 12 has seared sides for locking. The sears of the ratchet member 12 are conformed to fit snugly within the locking teeth of a stop lock bracket 47 (shown in FIGS. 2F & 2G. Now referring to FIGS. 2F & 2G, the stop lock bracket 47 is a device with a jagged edge head and an extending arm from the header of the device. A stem extension is a spar with two ends with which one end connects to the arm of a stop lock bracket 47 and the other end to a key cylinder 49. A key cylinder 49 is a device with an internal system, which can be provoked to lock when turned by a key 45. The key 45 is a bougie, which is perforated to fit through a key entrance 44 (shown in FIGS. 2 & 2C) and within the key cylinder 45. The key entrance 44 is a key 45 external placket set on the header side of the bottom frame embodiment 21 of the invention.

Referring now to FIGS. 2 and 2E, which shows a detailed view of the present invention in perspective together. A rotary spool 17 having the paper webbing 1 wound thereon is mounted to a spool mount 15. The spool mount 15 is mounted to a bush 2 such that a sun gear 3 is located centrally through an aperture in the bush 2 and away from the paper webbing 1. Three planetary gears 4 are rotatably mounted on the bush 2 by means of stub axles 5 and are positioned for driving engagement with the sun gear 3. A ring gear 6 is provided having a toothed inner surface with which it engages the planetary gears 4. A spigot 7 protrudes from the center of the outer surface of the ring gear 6 and receives one end of a coiled retraction spring 8 in a slot 9 provided therein. The slot 9 in the spigot 7 also helps to locate and secure a ratchet member 12 on the spigot 7. The outer end of the coiled retraction spring 8 is arranged to be secured to the inner surface of a drum 10, which, when the mechanism is assembled, encapsulates the gearing system. The drum 10 has a central orifice 11 through which the spigot 7 extends so as to connect to the ratchet member 12. A comfort spring 13 is secured at one end to the outside of the drum 10 and at its other end to a boss 14 and so rotate the drum in a clockwise direction. The clockwise rotation is parallel to the rotation of the ratchet member 12 whereby ratchet member 12 is possible next to a stop lock brake 47, which is attached to a stem extension and key cylinder therefore forming a locking system with the insurance of a key 45 and the key entrance 44.

OPERATION OF INVENTION

Figure 1A:
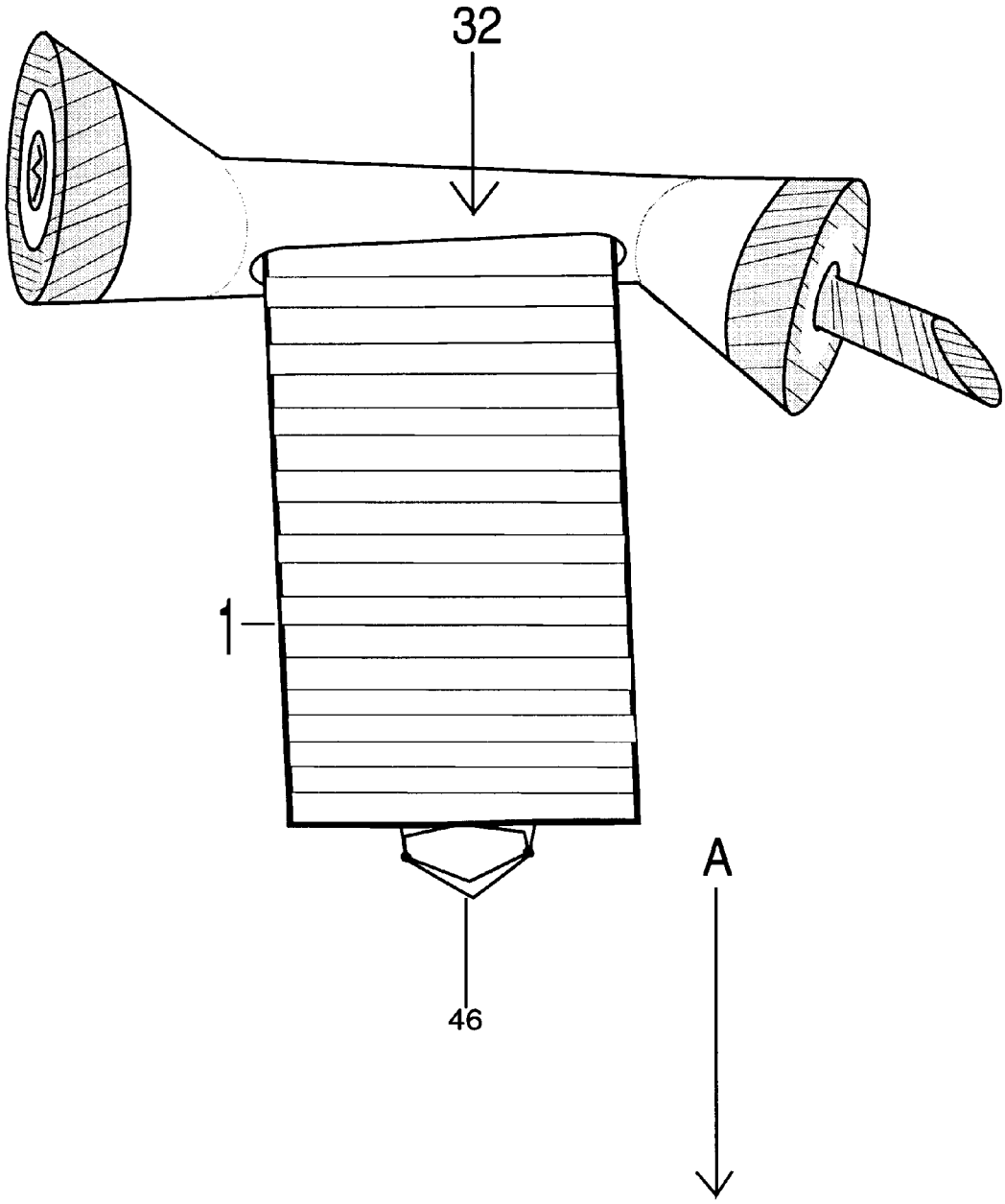
Figure 1E:
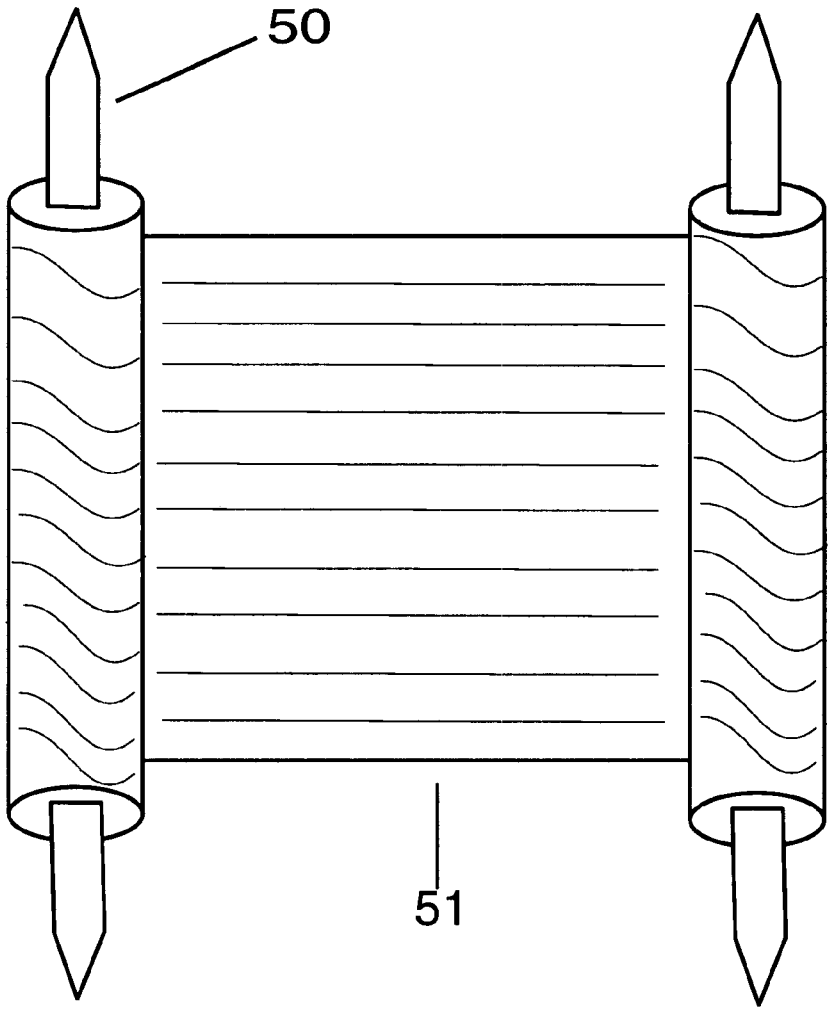
Figure 1E Prior Art

The operation of the mechanism is as follows. When the handle 46 (FIGS. 1 & 1A) is pulled by human force to extract the paper webbing 1 (FIGS. 1 & 1A) from within the central frame embodiment 19 and through the exit 32 (all shown in FIGS. 1, 1A, 2A, & 2B,) the rotary spool 17 (FIGS. 2 & 2E) rotates in a direction indicated by arrow A in FIG. 2 and arrow A in FIG. 2B. This causes rotation of the sun gear 3 (FIGS. 2 & 2E) by means of the attaching spool mount 15 (FIGS. 2 & 2E) and the corresponding (reduced) rotation of the three planetary gears 4 and the ring gear 6 (FIGS. 2 & 2E). Rotation of the ring gear 6 causes the retraction spring 8 to tighten around the spigot (FIGS. 2 & 2E). It should be recalled that the inner end of the retraction spring 8 (FIGS. 2& 2E) is secured in the slot 9 (FIGS. 2 & 2E) of the spigot 7 while the outer end of the retraction spring 8 (FIGS. 2 & 2E) is secured to an engagement formation (not shown) on the inner surface of the drum 10 (FIGS. 2 & 2E). Tightening of the retraction spring 8 (FIGS. 2 & 2E) occurs as the spigot 7 (FIGS. 2 & 2E) rotates relative to the drum 10 (FIGS. 2 & 2E). Rotation of the spigot 7 also causes rotation of the ratchet member 12 (FIGS. 2E & 2G). The teeth 23 of the locking teeth wheel 22 (FIG. 2B) are oriented such that with the engagement of the rotation of drum 10 (FIGS. 2 & 2E) in the direction of arrow A (FIGS. 2 and 2B) are still possible, but rotation thereof in the direction of arrow B of FIG. 2B, which corresponds to paper webbing 1 retraction is not possible. When the paper webbing 1 of FIG. 1A extraction is complete, the coiled retraction spring 8 of FIGS. 2 & 2E cannot urge the paper webbing 1 back into a retracted position because the ring gear 6 of FIGS. 2 & 2E is prevented from rotating, except in conjunction with drum 10, and spigot 7 by engagement of the locking lever 24 and teeth 23 all of FIG. 2. This is due to the locking of drum 10 and the spigot 7 of FIGS. 2 & 2E by means of the engagement of locking lever 24 and teeth 23 of FIGS. 2 & 2B; the retraction spring 8 of FIGS. 2 & 2E is rendered ineffective and also rotation of the drum 10 (FIG. 2E) and spigot 7 (FIG. 2E) as one unit under the driving force of the comfort spring 13 of FIGS. 2 & 2E which, in turn serves to retract the paper webbing 1 of FIG. 1A. Initial retraction of the paper webbing 1 is therefore controlled by the rotation in the direction of arrow B of drum 10 of FIG. 2B under the influence of the comfort spring 13 (FIG. 2) with its tail end connected to the bush 2 via boss 14 of FIG. 2. The comfort zone provided by this arrangement, last for the duration of an approximately 270-degree turn of the drum 10 of FIG. 2E. The effect of the planetary gear 4 system (FIG. 2) is that the ¾ turn of the drum 10 of FIGS. 2 & 2E generates a comfort zone of some 3.3 turns in the rotary spool 17 (FIGS. 2 & 2E). When the locking lever 24 (FIG. 2B) is disengaged from the teeth 23 (FIG. 2B) by means of pushing the release button 25 of FIG. 2 which engages the head of a release button shaft to the tail end of the locking lever 24 of FIG. 2 thus, deactivating the spring back action in a locking lever spring 26 (FIG. 2), enabling a ring gear 6 (FIG. 2), to then rotate freely under the influence of the coiled retraction spring 8 (FIGS. 2 & 2E), therefore causing the paper webbing 1 of (FIG. 1A) to retract back through the exit 32 and aligner 30 (FIGS. 2A & 2B). Since some retraction of the paper webbing 1 (FIG. 1A) has already occurred under influence of the comfort spring 13 (FIGS. 2 & 2E), the coiled retraction spring 8 (FIG. 2E) serves to rotate the drum 10 (FIG. 2E), relative to the (then stationary) spigot 7 (FIGS. 2 & 2E) and in a direction that unwinds (biases) the comfort spring 13 (FIGS. 2 & 2E) for future use.

Figure 2F:
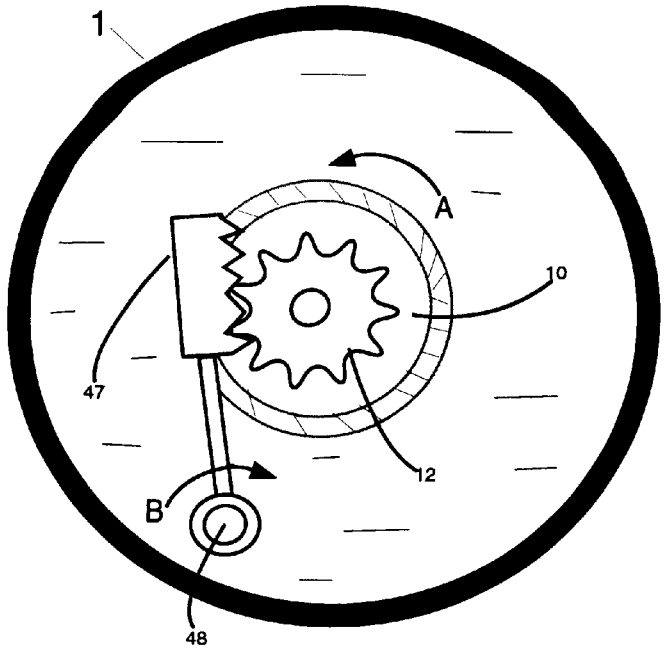
Figure 2G:
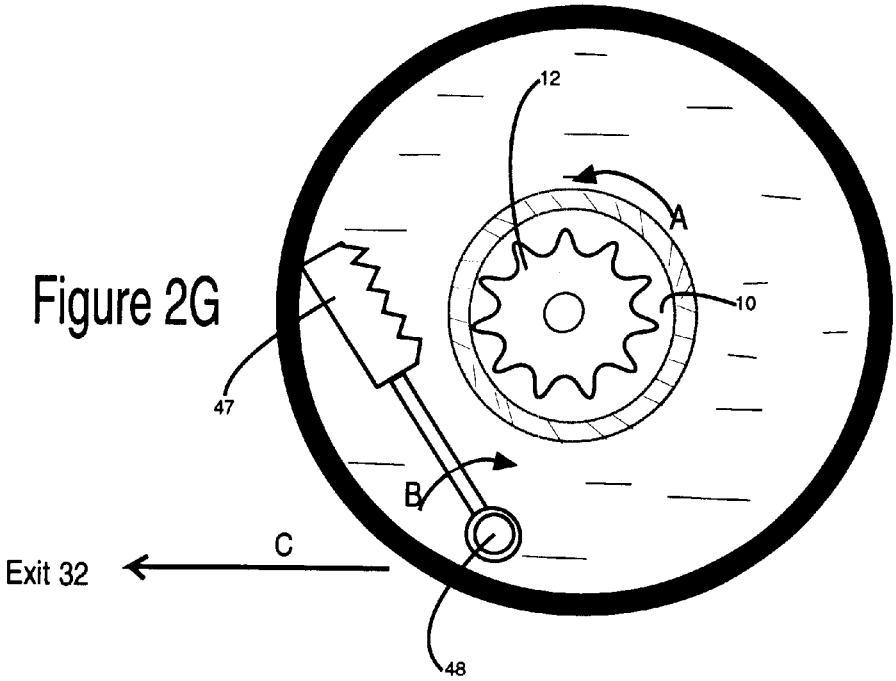
Figures 3, 3A, 3B, 3C, 3D, 3E, 3F, 3G, 3H, 3I, 3J, 3K, 3L, 3M, 3N, 3O, 3P, 3Q, 3R, 3S, 3T, 3U, 3V, 3W, 3X, 3Y, 3Z:
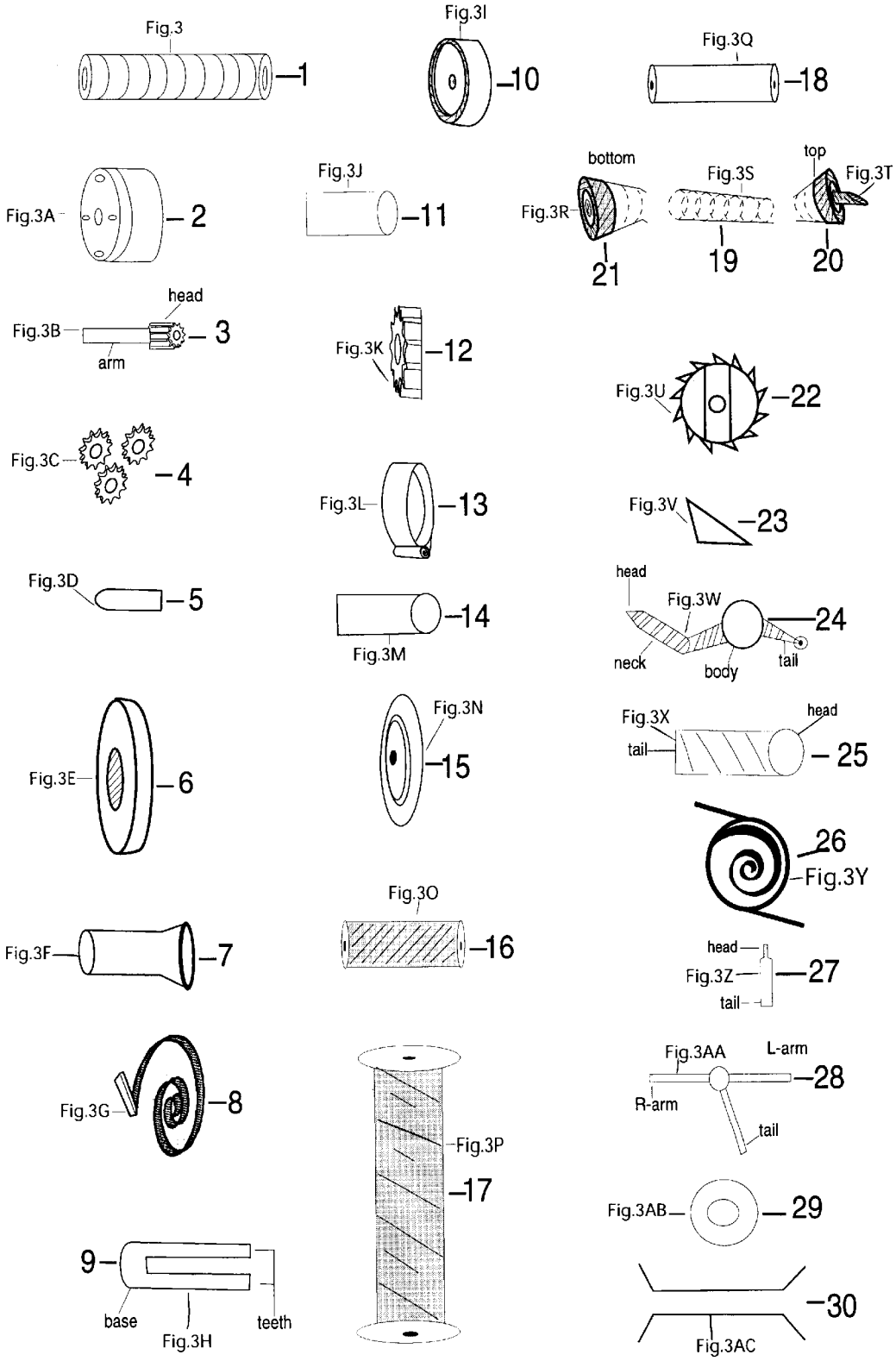
Figure 3A:
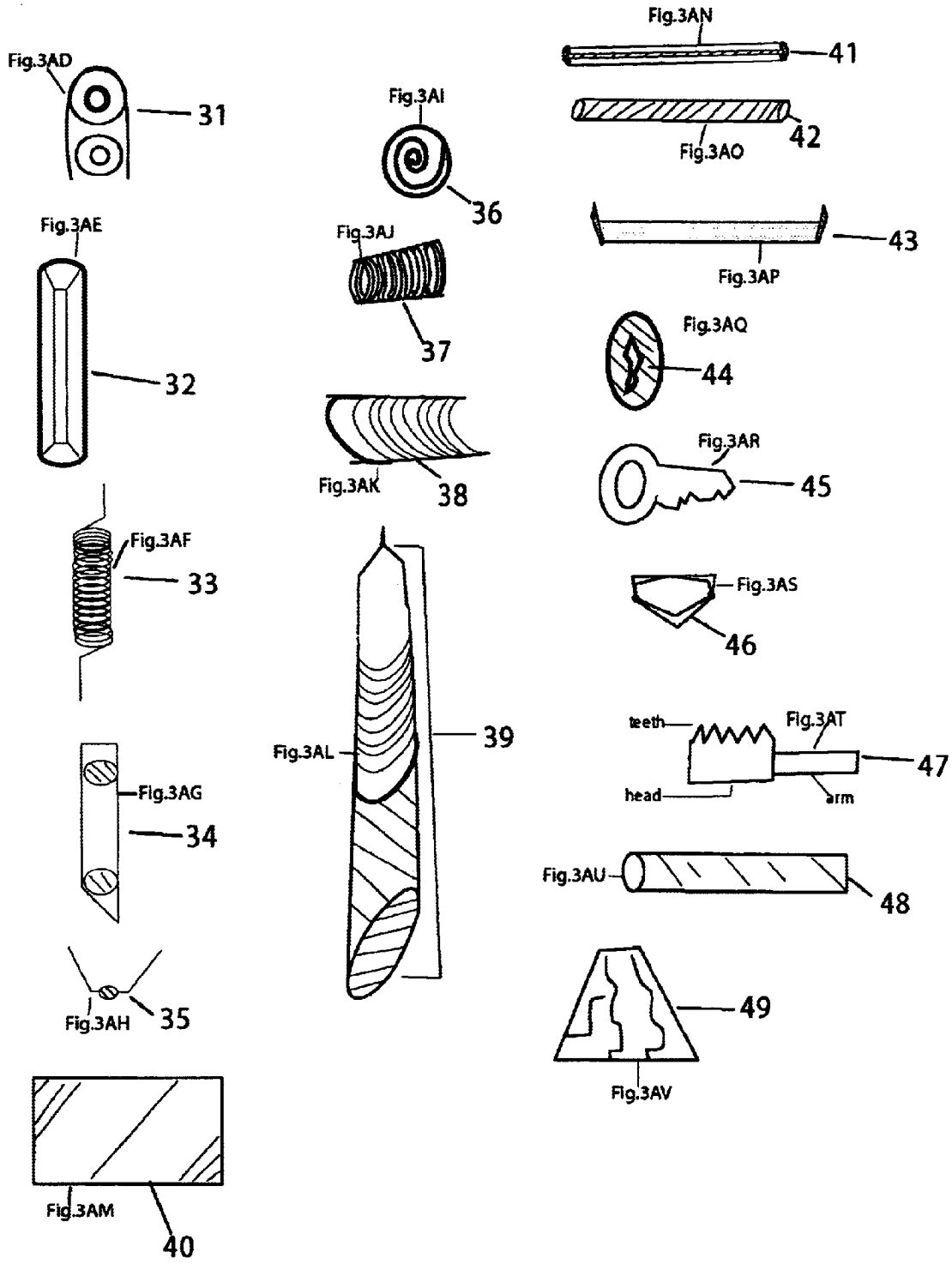

Operation of the illustrated embodiment of the present invention now described with particular references to FIGS. 2F and 2G. As the ratchet member 12 turns relative to the spigot 7, ring gear 6, and drum 10 (FIG. 2) the expulsion of the paper webbing 1 (FIG. 1A can be put to a stop or under lock mode by means of engagement of the stop lock bracket 47 to the ratchet member 12 (FIGS. 2F & 2G) from within the bottom frame embodiment 21(FIG. 1). By entering the key 45 (FIG. 2) into the key entrance 44 (FIG. 2) of the bottom frame embodiment 21 (FIG. 2) and therefore turning clockwise, the key cylinder 49 (FIG. 2) engages the stem extension 48 (FIG. 2) in the direction of arrow B of FIG. 2G. When this engagement takes place, the attaching stop lock bracket 47 (FIG. 2F) is engaged against the ratchet member 12 (FIG. 2F) causing a cease motion to occur. As the ratchet member 12 (FIGS. 2 & 2E) is under direct influence of drum 10, spigot 7, ring gear 6 and sun gear 3 (FIGS. 2 & 2E), so are these in reverse under direct influence of the ratchet member 12 (FIG. 2F) when engagement of stop lock bracket 47 occurs (FIG. 2F). Thus, exertion of the paper webbing 1 through a exit 32 (shown in FIGS. 1, 1A, & 2A) in the direction of arrow C of FIG. 2G and arrow A of FIG. 1A will not be permitted.

Referring now. particularly to (but not limited to) FIGS. 2 and 2B for the operation of the present invention. When the exertion of the paper webbing 1 (FIG. 1A) though exit 32 (FIG. 1A) begins, the top roller 16 (FIG. 2B) is flush with the paper webbing 1 (FIG. 2B). As the paper webbing 1 rotates, the top roller 16 (FIG. 2B) also rotates parallel to it in a reduced rotation therefore eliminating slack buildup within the central frame embodiment 19 (FIG. 1). The paper webbing 1 (FIG. 2B) goes around the bottom roller 18 (FIG. 2B) and through the roller aligners 31 FIG. 2B) for a smooth and consistent flow over the small roller 29 (FIG. 2B), through the aligner 30 (FIG. 2B) and finally through exits 32 (also shown in FIGS. 1, 1A & 2A). Both top roller 16 and bottom roller 18 are held in place by top roller mount 35 and bottom roller mount 34 via bottom roller mount spring 33 all of FIG. 2B.

Referring now to FIG. 1B of the operation for the present invention. Once the paper webbing 1 (FIG. 1A) has been exerted upon desire as in FIG. 1A; the pen 39 which is appendixes partially within the top frame embodiment 20 through a pen entrance 36 and secured by means of engagement of a external treads 38 and a internal tread 37, can be unscrewed and detached for writing devotionals and etceteras upon the paper webbing 1 in its extended form as in FIG. 1A.

Referring now to FIG. 1 only of the operation for the present invention. When paper-webbing 1 has been completely written on or there is a desire to change paper webbing 1 for new paper webbing, the following must be done. First pull the handle 46 to extend the paper webbing to its full-extended position. Once the full-extended position of the paper webbing 1 has been accomplished, an extension flap 40 that is red in color (not shown) will be an alert to the user that the paper webbing 1 can be changed at that point. The user must then place fingers over and under a bolt mount 43 and slide bolt 42 via bolt mount 43 through the gap of a socket 41 in the direction of arrow A of FIG. 1 for disconnection. Once the disconnection has occurred the extension flap will not retract because of the engagement of the teeth 23 and the locking lever 24. The no-retraction of the extension flap can further be secured by the engagement of the locking system with the key 45 once the paper webbing has been extended to a full extension for replacement.

Summary, Ramifications, and Scope

Accordingly, the reader will see that the prayer scroll of this invention can be used for writing information onto the paper for supplication of many individuals or things at one time without worrying about who or what will be forgotten. It can also be used as a type of safe storage for documentation or paintings because of being under lock and key. In addition, the prayer scroll abilities can be broadened to an electronic device which would allow even more information to be installed for prayers and safe keeping; in which information could be downloaded into the electronic chip of the prayer scroll from any compatible computer; and then taken into the field for prayer. Furthermore, the prayer scroll has additional advantages in that it permits the production in a variety of sizes and colors, which would not require a separate facility for compounding. The ink of the writing pen and paper webbing can also come in a variety of colors. The external surface of the prayer scroll can even have your name, inscription or logo onto it. The external surface of the invention can be made out of wood, metal, plastic, rubber, marble and even decorated with Gold, Silver, or brass trimmings. All of the internal components of the invention can be made out of metal or plastic. Because of the variety in design features of the invention, the central frame embodiment of the invention can be tailored to fit comfortable within the carrier's hand. Although the primary shape of the current invention will be in a cylinder form with opposite facing obtuse angled ends, it can also be made in the form of a rectangle, square, circle or normal cylinder format.

I claim:

1. A prayer scroll comprising:

a hollow frame having an exit slot;

a spool disposed within the frame;

a flexible extension flap secured to the spool and a writing sheet removably secured to the flap, the flap and writing sheet configured to pass through the exit slot and to be wound onto the spool;

a spring connected to the spool and biasing the spool to rotate in a first direction to thereby wind the flap and writing sheet onto the spool;

means for releaseably preventing the spool from rotating in the first direction, including a manually operable release means for enabling the spool to rotate in the first direction; and a releasable lock connected to the spool to prevent the spool from rotating in a second direction in which the writing sheet and flap are unwound from the spool.

2. The prayer scroll of claim 1, wherein:

the lock has a removable key.

3. The prayer scroll of claim 1, wherein:

the manually operable release means includes a release button.

4. The prayer scroll of claim 1, wherein:

the writing sheet is paper.

* * * * *